US006507723B2

(12) United States Patent
Zalewski

(10) Patent No.: US 6,507,723 B2
(45) Date of Patent: Jan. 14, 2003

(54) IMAGE DEVELOPER THAT PROVIDES FLUIDIZED TONER

(75) Inventor: Wojciech Zalewski, South Easton, MA (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/768,868

(22) Filed: Jan. 24, 2001

(65) Prior Publication Data

US 2002/0098015 A1 Jul. 25, 2002

(51) Int. Cl.[7] ..... G03G 15/08
(52) U.S. Cl. ..... 399/292
(58) Field of Search ..... 399/252, 290–293, 399/27

(56) References Cited

U.S. PATENT DOCUMENTS 4,777,106 A 10/1988 Fotland et al. ..... 430/120
5,570,170 A 10/1996 Muranyi et al.
5,630,200 A * 5/1997 Christy ..... 399/292 X
5,656,409 A * 8/1997 Christy et al. ..... 399/293 X
5,734,955 A * 3/1998 Gruber et al. ..... 399/292 X
5,754,930 A 5/1998 Stark et al. ..... 399/290
5,799,227 A 8/1998 Matheis et al. ..... 399/92
5,899,608 A * 5/1999 Eklund et al. ..... 399/290 X
6,226,482 B1 * 5/2001 Christy et al. ..... 399/252

FOREIGN PATENT DOCUMENTS

EP 494454 B1 4/1996

* cited by examiner

*Primary Examiner*—William J. Royer
(74) *Attorney, Agent, or Firm*—Oliff & Berridge, PLC

(57) ABSTRACT

Methods and systems for providing a generally fluidized toner in an image developer system utilized in an image forming system are provided. The method includes introducing a fluid, such as atmospheric air, into a chamber containing toner particles to fluidize the toner. The fluid-like characteristics of the fluidized toner may be used to delump and transport the toner, and to detect the toner level.

19 Claims, 7 Drawing Sheets

IMAGE DEVELOPER THAT PROVIDES FLUIDIZED TONER

TECHNICAL FIELD

The present invention relates generally to image forming systems, and specifically relates to latent image developer subsystems in such systems.

BACKGROUND OF THE INVENTION

Toner imaging systems of the type where a latent charge image is developed with a pigmented toner are widespread in the office and home. Once developed with the toner, the image is transferred to a receiving member to form a printed image on a substrate, such as a sheet of paper.

Many technologies exist for forming a latent charge image, including optical image projection onto a charged photoconductive belt or drum, charging a dielectric member with an electrostatic pin array or electron beam, and charge projection from a so-called ionographic print cartridge or plasma generator. Once a latent image is formed, the latent image may be transferred to an intermediate member before development. Alternatively, the latent image may also be developed on the same member as that on which it is formed, with different system architectures having evolved to address different process priorities, such as cost, speed, preferred type of toning system or intended receiving substrate.

Regardless of the image forming system utilized, an image developer having a developer roll and toner is typically utilized to develop the latent image. The developer roll, having a supply of toner, transfers the toner to the imaging member to develop the latent image thereon. Toner conditioning and feeding to the developer roll is commonly done gravitationally, along with mechanical agitation to prevent agglomeration or lumping of toner particles. Such lumping makes it difficult to develop the image uniformly, detect the toner level, and can result in print deletions. The mechanical and electrical properties of the toner are affected by environmental moisture and compaction.

One attempt to circumvent the aforementioned problem has used a gas to convey the toner to different parts of the image developer. Specifically, a stream of rapidly moving gas is used to convey the toner from one device to the next. The stream of gas helps prevent the toner from lumping. Unfortunately, the relatively rapid speed of the fluid used to convey the toner results in toner loss to the atmosphere. The use of a conveying gas, therefore, is often accompanied by additional hardware, such as filters and covers, to attempt to recapture the toner particles lost by the conveying process; however, even if a filter or a cyclone or both can be used to collect the particles conveyed away, the toner loss is not eliminated because the collected particles are not reusable.

SUMMARY OF THE INVENTION

Because of the aforementioned problems associated with the use of a toner in an image forming system, there exists a need for a gentle means of transporting, agitating, and conditioning toner particles in an image developer so that the toner is delivered to the developer roll without excessive loss of toner, and in a state conducive to consistent development.

In the present invention, an image developer system employs a fluid (i.e., a gas or liquid) to fluidize the toner particles for conditioning and transporting the toner within the image developer system without mechanical agitation, or conveyance. When in the state of fluidization, the toner behaves like a liquid, therefore allowing liquid-like handling. The hydrostatic pressure of the fluidized toner is advantageously employed to measure and detect the toner level, and to transport the toner. The fluidization process is gentle enough to prevent substantial loss of toner particles to the atmosphere, but intense enough for proper mixing. The use of dry air as the fluidization fluid, with a dew point brought below −40° F. at room temperature and atmospheric pressure, aids in toner delumping, and stabilizes the fluidization process.

A bed of toner particles may be subjected to a stream of fluid, such as air, moving at a given velocity. If the velocity of the fluid stream is made to increase, there arrives a point at which the vertical component of the drag force exerted by the fluid stream on the particles approximately cancels the gravitational force on the particles. The particles become suspended, and are said to be fluidized. As the velocity of the fluid stream increases, the pressure drop across the bed remains essentially constant. In this regime, where the pressure drop remains essentially constant, the toner particles are still fluidized. As the velocity of the fluid is increased further, however, there comes a point where the vertical component of the drag force and the gravitational force no longer cancel. The magnitude of the vertical component of the drag force exceeds the magnitude of the gravitational force, and the toner particles are carried by the fluid stream. This point signals the end of the fluidization regime, when the fluid ceases to be fluidized, and the start of the conveyance regime. A fluidized toner is used advantageously in the invention described herein.

In particular, an image developer system for providing a generally fluidized toner suitable for use in an image forming system is described herein. The image developer system includes a chamber for housing toner particles, and a fluid source for introducing fluid into the chamber at a velocity to fluidize the toner particles to yield a generally fluidized toner having substantially fluid characteristics. The velocity of the fluid introduced into the chamber may be between about 0.003 cm/s, for lightweight (0.5 g/cm$^3$) and small (5 micrometers) toner particles, and about 8.4 cm/s, for heavy (3 g/cm$^3$) and big (30 micrometers) toner particles. The velocity may be defined as a ratio of the volumetric flow rate of the fluid to the cross-sectional area of a fluidized bed.

The image developer system may further include a pressure distributor for distributing the fluid substantially evenly throughout a bottom of the chamber, and a level sensing subsystem for measuring a level of the toner particles in the chamber. Moreover, the fluid source may include a conditioning element to condition the fluid prior to introduction to the chamber. The chamber may also have an angled wall for promoting circulation of the generally fluidized toner therein. In addition, the image developer system may include a developer roll for attracting the fluidized toner onto a surface thereof.

The level-sensing subsystem may include a bubble tube. Specifically, the liquid-like behavior of the fluidized toner allows the use of the bubble-tube to detect the toner level in a fluidized chamber. A hollow (a few mm in diameter) tube, fixed to a wall of a chamber, and immersed in the toner, may duct a low velocity (a few cm/s) flow of the same fluidizing fluid. The static pressure at the outlet of the tube is equal to the hydrostatic pressure of a column of the fluidized toner above the outlet. A pre-set pressure switch, hermetically attached to the bubble tube, can detect the level corresponding to the pre-set pressure value of the switch, providing an electrical signal to a process controller. Many differently pre-set switches may be attached to a single bubble tube to detect many predetermined toner levels. For example, two pre-set switches can detect two levels, three pre-set switches can detect three levels, etc.

The use of a particular fluidizing fluid to fluidize the toner helps to treat or condition the toner to maintain or to modify the properties of the toner particles for effective development of images. For example, moisture in the ambient (atmospheric) air favors the formation of toner lumps and affects the stability of the electrical properties (conductivity) of toners. Fluidization may be successfully employed to keep the toner dry, thereby prevent the variation in the conductivity of the toner, resist the tendency of toner bridging and lump formation, and assist in toner de-lumping if it occurs. For example, the use of dry air as a fluidizing fluid, with a dew point brought below −40° F. at atmospheric pressure, may be advantageous. The fluidization process also provides the means of transporting the toner in a controlled fashion without the use of mechanical methods which often produce undesirable effects.

DETAILED DESCRIPTION OF THE INVENTION

An image developer system is presented herein for providing a generally fluidized and conditioned toner suitable for use in an image forming system. Image forming systems include electrophotographic, electrostatic or electrostatographic, ionographic, and other types of image forming or reproducing systems that are adapted to capture and/or store image data associated with a particular object, such as a document. The system of the present invention is intended to be implemented in a variety of environments, such as in any of the foregoing types of image forming systems, and is not limited to the specific systems described below.

Figure 1:
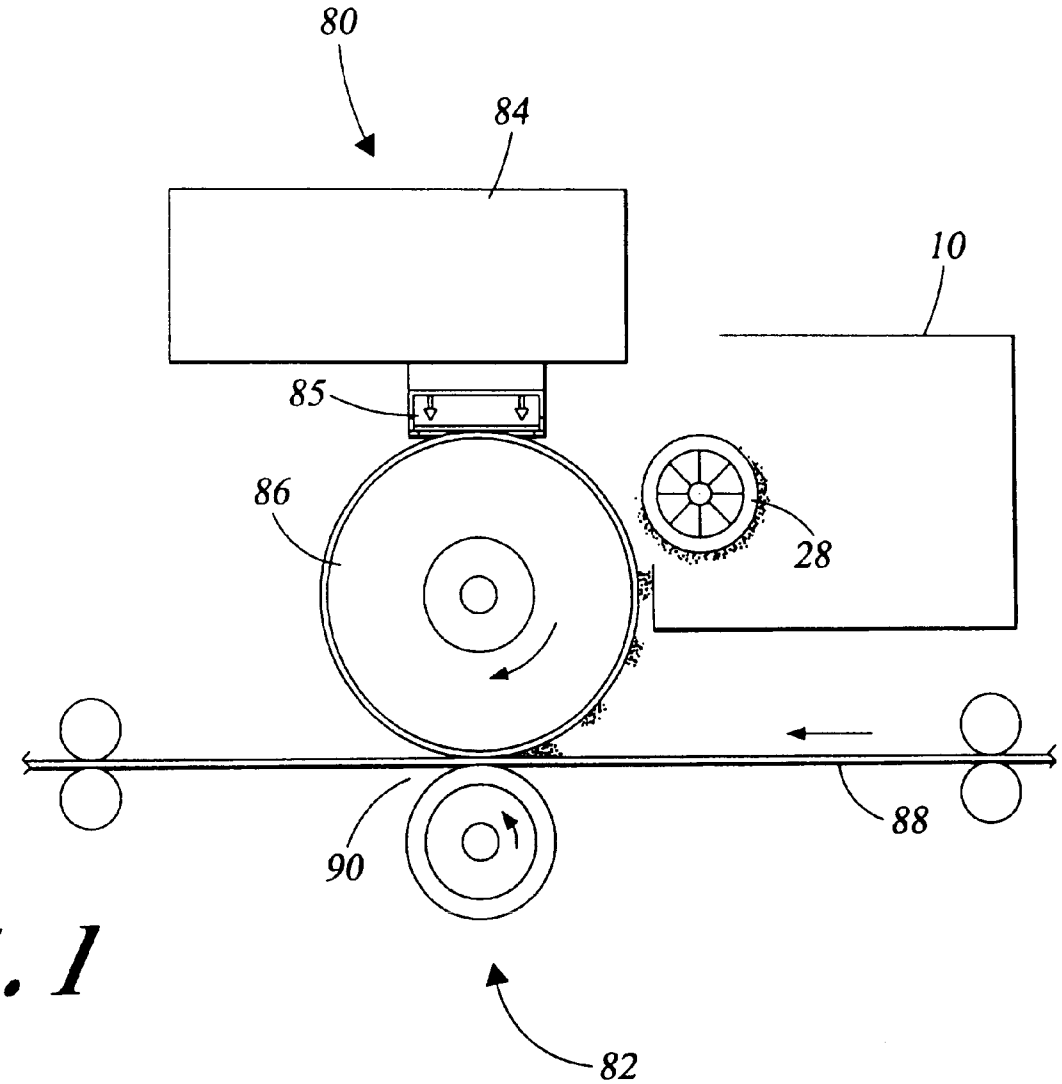
FIG. 1 shows a schematic of an image forming system.

Referring to FIG. 1, an image forming system 80 is shown. The image forming system 80 includes a pressure member 82, an imaging center 84, and an imaging and transfer member 86. The system 80 further includes an image developer system 10 having a developer roll 28.

The imaging center 84 has a charge-emitting device 85, such as an electron beam imaging head, for forming a latent image on a dielectric surface of the imaging and transfer member 86. The latent image may then be developed with toner particles from the developer roll 28. The image developer system 10 encases the developer roll 28, and houses and conditions the toner prior to the application of the toner on the imaging and transfer member 86. The developed image may then be transferred to a substrate 88, such as a sheet of paper, at a transfer nip 90 formed between the imaging and transfer member 86 and the pressure member 82.

The image forming system 80 shown in FIG. 1 is of the type where the imaging member, the device on which the latent image is formed, and the transfer member, the device that directly transfers the developed image to the substrate, are coincident. Thus, the imaging and transfer member 86 functions as both a device to form an image thereon, and as a device to transfer the image onto the substrate 88. In other embodiments, the imaging member may first transfer the developed image onto a distinct transfer member, before the transfer member transfers the image to the substrate. The distinct transfer member can be a drum, or belt, for example.

Figure 2:
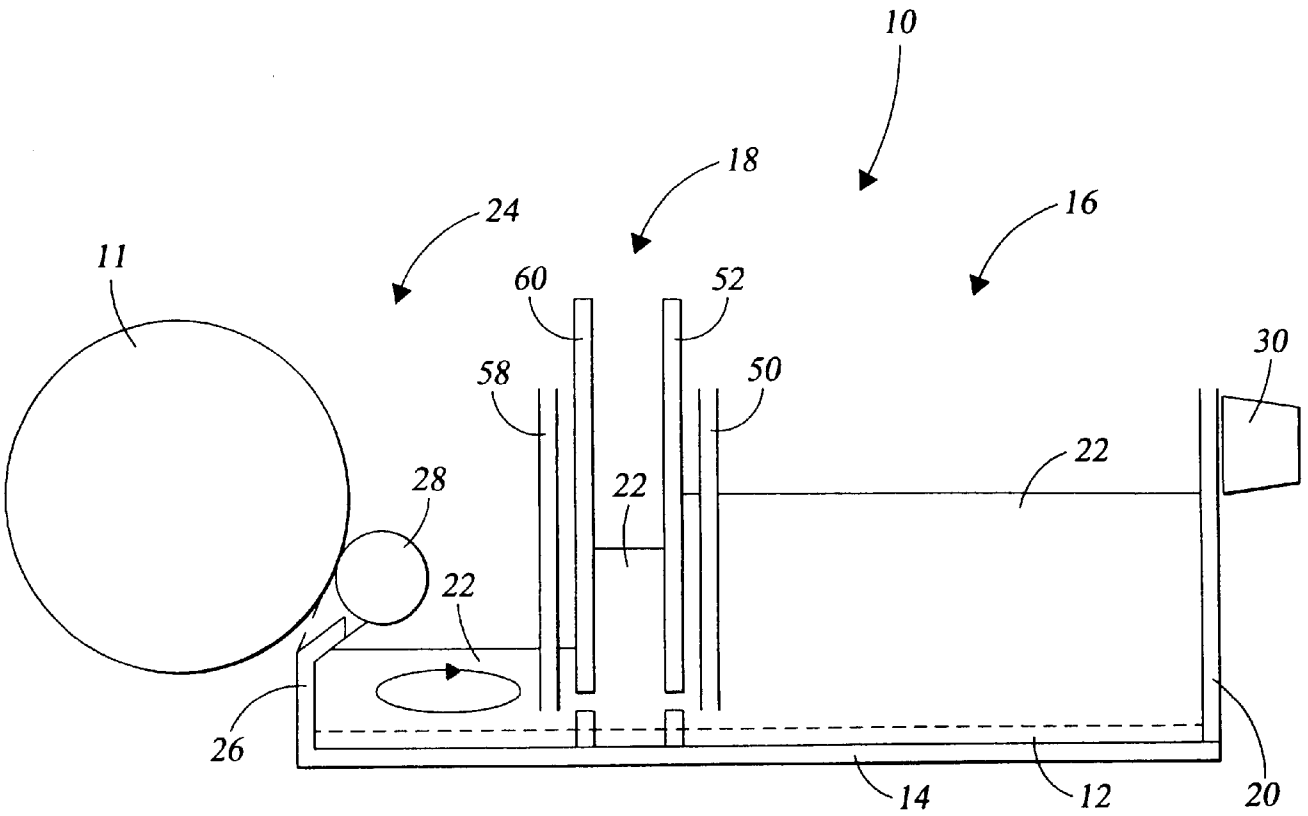
FIG. 2 shows an image developer according to the teachings of the present invention.

Referring to FIG. 2, an image developer system 10 for providing a generally fluidized and conditioned toner suitable for use in an image forming system is presented. The image developer system 10 comprises a fluid source 38 (FIG. 3), a pressure distributor 12 in communication with the fluid source 38 (FIG. 3) that is mounted above a base plate 14. The image developer system 10 further includes a motor and toner station 16 and a level sensing station 18 contained within a housing. The motor and toner station 16 includes a toner chamber 20 housing fluidized toner 22. The image developer system 10 also includes a developer roll station 24 that includes a developer roll chamber 26 for housing fluidized toner 22 and a developer roll 28.

The fluid source 38 introduces a fluid into the toner chamber 20, the developer roll chamber 26, and the level sensing station 18 through the pressure distributor 12. The pressure distributor 12 distributes the fluid substantially evenly throughout the bottoms of the chambers 20 and 26 and the station 18. The fluid fluidizes the toner housed therein to yield a generally fluidized toner 22 having substantially fluid characteristics.

The fluid source 38 is capable of independently supplying predetermined amounts of fluidizing fluid on a continuous basis to the toner chamber 20, the developer roll chamber 26, and the level sensing station 18. Also the fluid source 38 feeds a first bubble tube 50, and a second bubble tube 58 described below.

The pressure distributor 12 allows fluid to pass through it from a fluid source 38 and distribute the fluid evenly. The pressure distributor 12 distributes the fluidizing agnent uniformly throughout the fluidizing chamber to produce the regimes of fluidization. The pressure distributor 12 may be common to all chambers or it can be configured individually for each chamber so fashioned as to cooperate with the fluidizing fluid in the execution of the treatment specific to the chamber. The pressure distributor 12 may be designed in a variety of configurations utilizing metallic or non-metallic, electrically conductive or non-conductive materials. The pressure distributor 12 may be formed from a perforated, sintered or otherwise porous plate, either single or sandwiched and staggered, or a packed bed of solid particles, all of which may be formed flat or concave or convex.

The motor and toner station 16 includes an electric motor 30 for driving the developer roll 28 in the developer roll station 24. The motor and toner station 16 also houses a supply of fluidized toner 22 within the system 10 for image developing. The level sensing station 18 functions to maintain an appropriate level of fluidized toner 22 within the image developer system 10 by transferring the toner from the toner chamber 20 to the developer roll chamber 26, as needed.

The developer roll station 24 includes the chamber 26 used to house fluidized toner 22, which is then transferred to the developer roll 28. The developer roll 28 is suitable for transferring the toner to an image member 11 to develop latent images on the image member 11.

Figure 3:
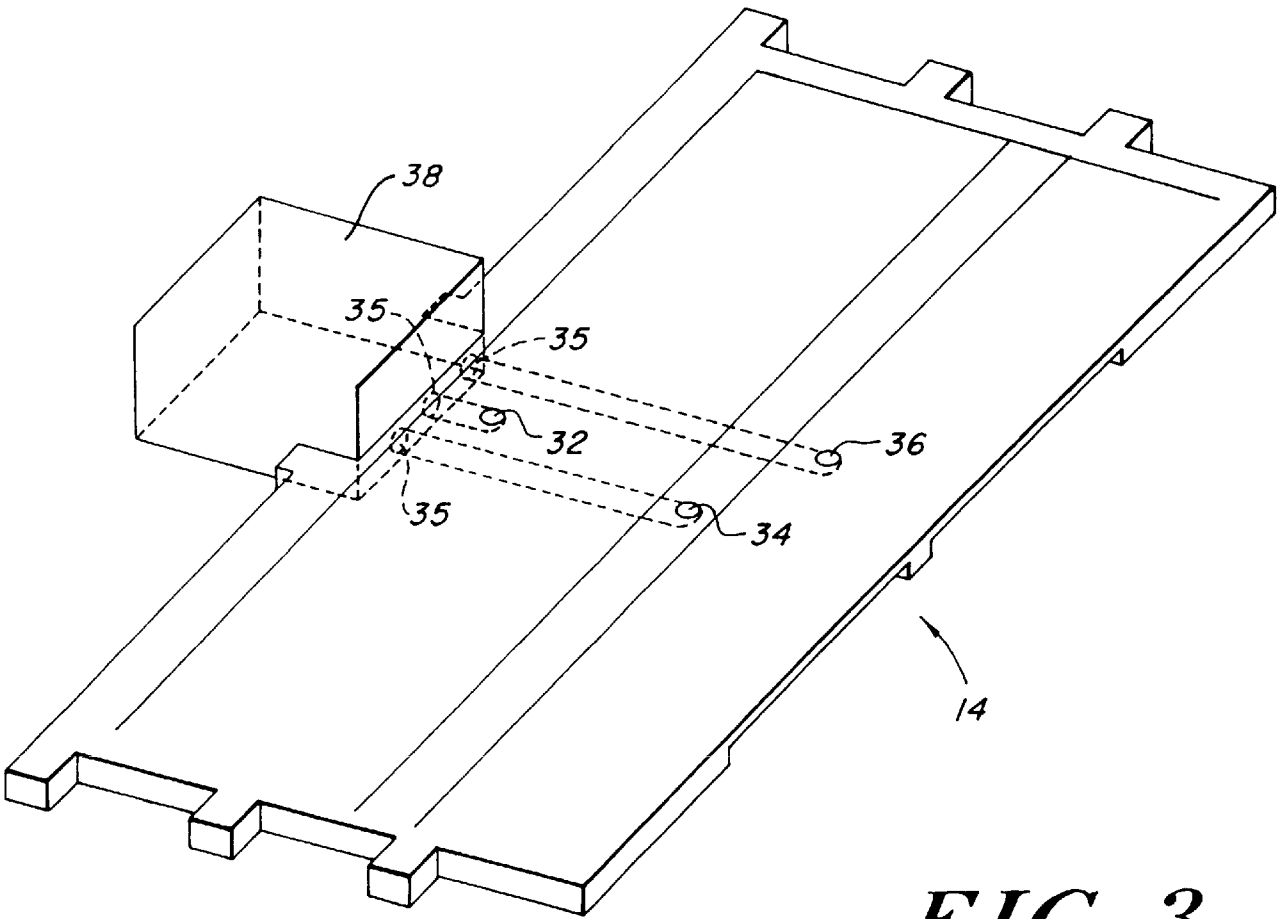
FIG. 3 shows a base plate for an image developer according to the teachings of the present invention.

Referring to FIG. 3, the base plate 14 of the system 10 is shown according to one embodiment of the present invention. The base plate 14 includes a toner chamber fluid-intake port 32, a level sensing station fluid-intake port 34, and a developer roll chamber fluid-intake port 36. Also shown is a fluid source 38 coupled to each of the ports 32, 34, and 36.

The base plate 14 functions as a foundation for the image developer system 10, above which the pressure distributor 12 and stations 16, 18, and 24 are disposed. The fluid source 38 provides a fluid, such as atmospheric air, to the toner chamber 20, the level sensing station 18, and the developer roll chamber 26.

The fluid from the source 38 enters fluid supply ports 35 at the side of the base plate 14, travels in passages formed in the base plate 14, and enters the chambers 20 and 26, and the level sensing station 18, via the fluid-intake ports 32, 34, and 36.

The fluid source 38 may include a fluid conditioner to treat the fluid before injecting the fluid into the chambers 20, 26, or station 18. The fluid source 38, among other instrumentation, may contain a gas-drying device. For example, moisture can be removed from a flowing fluid, such as air, by utilizing a continuous automatic "pressure swing" drying scheme in which a two desiccant column device dries the supplied air under high pressure (high pressure column) and regenerates the previously used desiccant under low pressure (low pressure column). Such a drying scheme obviates the need for an operator to exchange and/or regenerate the spent desiccant.

The use of dry air as the fluidizing fluid, with the dew point brought below −40° F. at atmospheric pressure, aids in toner delumping, and stabilizes the fluidization process. The fluid from the fluid source 38 enters the fluid supply ports (not shown) at the side of the base plate 14, travels in passages formed in the base plate 14, and enters the toner chamber 20, the level sensing station 18, and the developer roll chamber 26 via fluid-intake ports 32, 34 and 36, respectively.

It should be understood that the fluid source 38 can be mounted directly on the image developer, as in FIG. 3, or alternatively be mounted and operated from a remote location. The source 38 may be capable of delivering premeasured (pre-set) amounts of fluidizing fluid on a continuous basis overcoming the resistance to flow imposed by the pressure distributor 12 above which the fluidizing processes take place.

Figure 4:
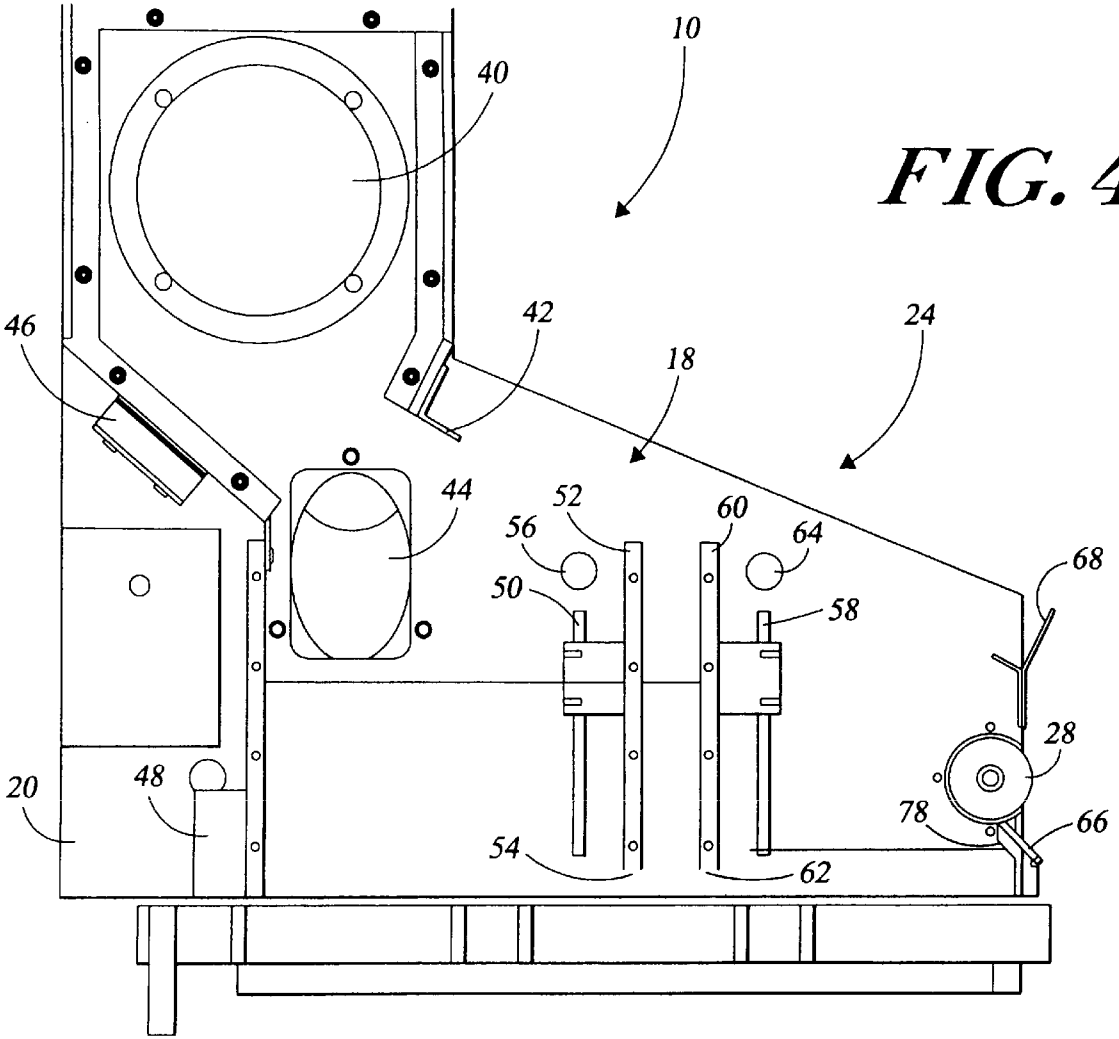
FIG. 4 shows an image developer according to the teachings of the present invention.

Referring to FIG. 4, a more detailed view of the image developer system 10 is shown that includes the motor and toner station 16. The motor and toner station 16 includes a toner cartridge opening 40, a smaller auxiliary refill port 44, and supports 42 and 68 for a filter or, alternatively, a hermetic cover. The fluidizing fluid may be vented through both the filter and/or a rectangular slot located between the developer roll 28 and the support 68. If the fluidizing fluid is to be recaptured for any reason, the opening should be minimized and the venting should take place through a mechanical, electrostatic, or other type of filter. If not captured, the method of venting is optional. The station 16 further includes a pressure switch mounting bracket 46. At least one handle 48 is also included to gain access to the toner chamber 20. The pressure distributor 12, which can be a sintered plate, sits on top of the base plate 14. The station 16 also includes an electric motor 30, whose belt and pulley are not shown.

The toner cartridge opening 40 is used for inserting a toner cartridge to replenish the image developer with toner. The auxiliary refill port 44 can also accept toner. The pressure switch mounting bracket 46 may be utilized to fasten a pressure switch described below.

A fluid, such as atmospheric air, from the fluid source 38 is injected into the toner chamber 20 via the toner chamber fluid-intake port 32 and the pressure distributor 12. The distributor 12 functions to distribute the fluid substantially evenly throughout a bottom portion of the toner chamber 20 containing a bed of toner particles.

When a fluid such as a gas is introduced into the bottom of the chamber 20 at generally low speeds, the fluid tends to pass through the voids between the toner particles, leaving the bed of toner particles at the bottom of the toner chamber 20 stationary. As the speed of the fluid is increased, the pressure drop through the bed of toner particles initially increases while the bed continues to remain substantially stationary. With further increases in the speed at which fluid is introduced into the bottom of the chamber 20, a speed, $V_{min}$, is reached in which the upward drag force on the particles is equal to the downward gravitational force on the particles. At the fluid speed $V_{min}$, the toner particles become suspended in the fluid stream and the toner particles are considered fluidized. The fluid speed $V_{min}$ is the minimum speed for fluidization. With increasing speeds beyond $V_{min}$, the pressure drop across the bed of toner particles remains substantially constant, until a speed $V_{max}$ is reached, at which point the pressure drop decreases rapidly. As the speed of the fluid is increased from about $V_{min}$ to $V_{max}$, the bed of toner particles expands, but the particles remain suspended in the fluid. At speeds greater than $V_{max}$, the particles are carried along, or conveyed, with the fluid, and the toner chamber 20 empties as particles are lost to the atmosphere. The regime of fluidization is generally considered to be between $V_{min}$ and $V_{max}$. The regime in which the speed of the fluid is greater than $V_{max}$ is the conveyance regime where the toner particles are conveyed with the fluid.

The actual values of $V_{min}$ and $V_{max}$ depend on the density of the toner particle and the toner particle size. For example, assuming a spherically shaped toner particle, for a density of 0.5 g/cm$^3$, and a particle volume of $5.2\times10^{-10}$ cm$^3$, $V_{min}$ is $3\times10^{-3}$ cm/s, and $V_{max}$ is $4\times10^{-2}$ cm/s. For a density of 3 g/cm$^3$, and a particle volume of $1.1\times10^{-7}$ cm$^3$, $V_{min}$ is 0.62 cm/s and $V_{max}$ is 8.4 cm/s. The particles in the toner chamber 20 are fluidized continuously whenever the image forming system containing the image developer system 10 is activated. The fluidized toner 22 flows from the toner chamber 20 to the developer roll chamber 26 until forces exerted on the particles within the chambers equilibrate. Within the regime of fluidization in which the fluid speed lies between $V_{min}$ and $V_{max}$, there may be sub-regimes, such as the particulate, bubbly, plug, slug, and turbulent regimes, as known to those of ordinary skill in the art. In one embodiment, the present invention employs a particulate sub-regime, in which the toner bed expands smoothly and homogeneously. Toner particles are uniformly distributed in the fluid, and the pressure is approximately constant throughout the fluid. The top surface of the bed is smooth and well defined. In another embodiment, the present invention employs a bubbling sub-regime, in which fluid bubbles are formed near the pressure distributor 12 and rise through the toner bed before breaking at the top surface of the bed. The top surface has the appearance of the surface of a boiling liquid. There are pressure fluctuations throughout the bed of toner particles.

The particles in the toner chamber 20 are fluidized continuously whenever the image forming system contains the image developer system 10 is activated. Fluidized toner 22 behaves in many respects like a liquid, thereby allowing liquid-like handling. The fluidized toner 22, for example, develops a hydrostatic pressure, which may be used to measure the toner level as described below. In addition, because of pressure differences between the fluidized toner in the toner chamber 20 and the developer roll chamber 26, the fluidized toner 22 can flow from the toner chamber 20 to the developer roll chamber 26 via the level sensing station 18, thereby replenishing the chamber 26. This flow can continue until the pressure differences vanish.

Referring again to FIG. 4, the level sensing station 18 included in the image developer system 10 is shown. A fluid, such as atmospheric air, from the fluid source 38 is injected into the level sensing station 18 via the level sensing station fluid-intake port 34 (FIG. 3) and the pressure distributor 12. The distributor 12 functions to distribute the fluid substantially evenly throughout a bottom of the sensing station 18.

The level sensing station 18 includes a first bubble tube 50 having a first bubble tube feed through 56. The first bubble tube 50 has a bottom end immersed in the toner in the toner chamber 20, and a top end connected to a flexible tube (not shown). The flexible tube carries fluid from the fluid source 38 to the top end of the bubble tube 50 via the first bubble tube feed through 56. The sensing station 18 further includes a first divider 52 and a first opening 54. The level sensing station 18 also includes a second bubble tube 58 having a second bubble tube feed through 64. The second bubble tube 58 has a bottom end immersed in the toner in the developer roll chamber 26, and a top end connected to a flexible tube (not shown). The flexible tube carries fluid from the fluid source 38 to the top end of the bubble tube 58 via the second bubble tube feed through 64. The station 18 further includes a second divider 60, and a second opening 62.

The level sensing station 18 may be utilized to sense the level of the fluidized toner 22. When the level of the fluidized toner 22 in the developer roll chamber 26 is sensed as low, fluid from the fluid source 38 is injected into the sensing station 18 continuously via the level sensing station fluid-intake port 34 (FIG. 3). The fluid is distributed evenly throughout the bottom of the station 18 by the distributor 12. By injecting fluid at a speed lying within the fluidization regime, the toner particles in the level sensing station 18 are fluidized, and fluidized toner 22 is transported from the toner chamber 20 to the developer roll chamber 26. When the level in the developer roll chamber 26 is replenished, fluidization of the toner in the station 18 stops, and the non-fluidized toner blocks the first and second openings 54, 62. When either the first opening 54, or the second opening 62 is blocked, toner cannot be transported from the toner chamber 20 to the developer roll chamber 26. The passage through the openings 54 and 62 is closed if the toner in the chamber of the level sensing station 18 is not fluidized, even if the toner in both chambers 20 and 26 is fluidized.

Figure 5A:
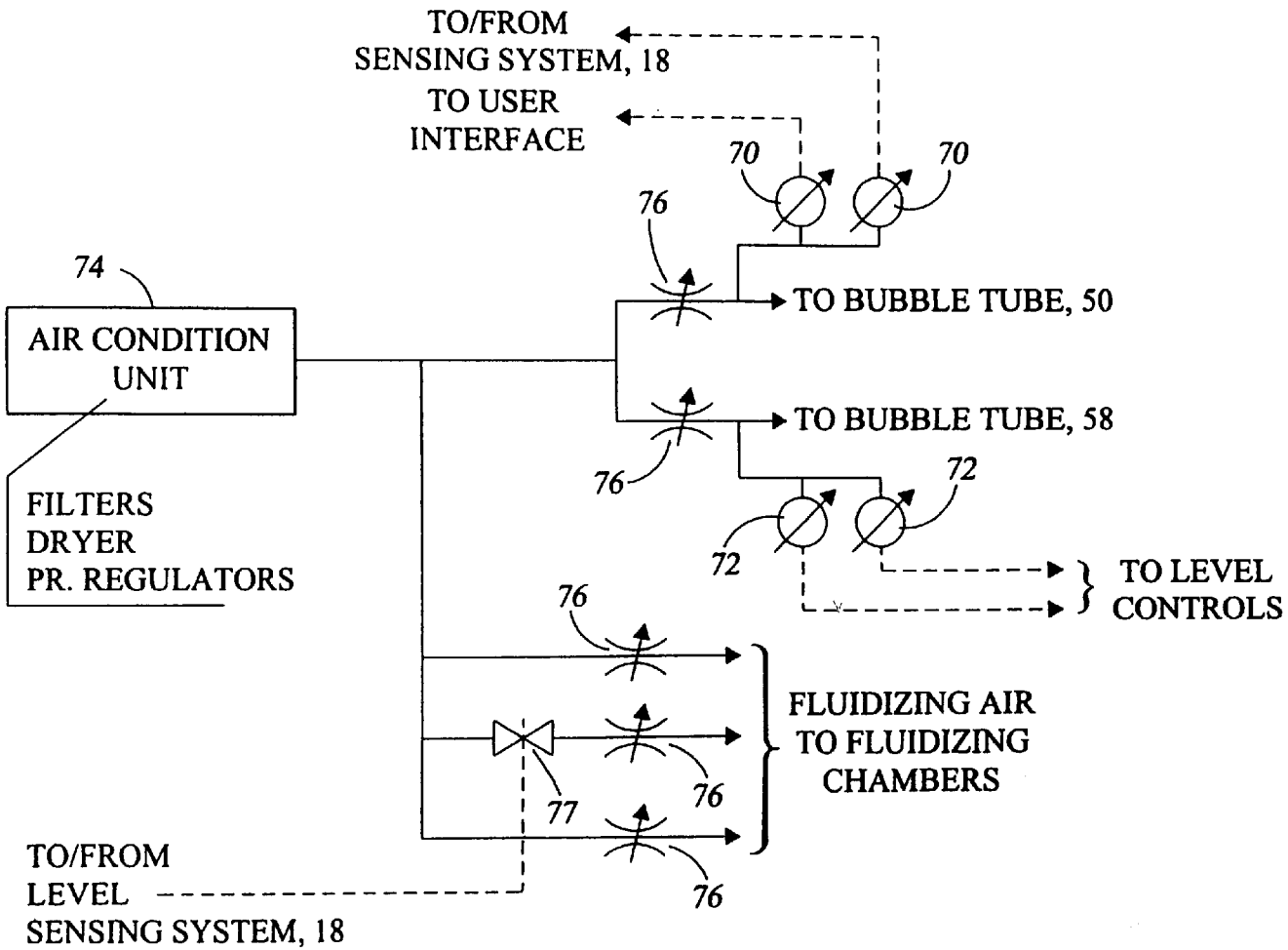
FIG. 5A shows a functional schematic of the pneumatics used in the image developer according to the teachings of the present invention.

Referring to FIG. 5A, a schematic diagram showing the pneumatics involved in level sensing is shown. Flexible fluid tubes (not shown) pass through the first and second feed throughs 56 and 64 and connect hermetically to the bubble tubes 50 and 58. A fluid is forced through these flexible tubes from a fluid conditioner unit 74 to the bubble tubes 50 and 58. The fluid conditioner unit 74 may be included in the fluid source 38 for the fluidization. Pressure switch 70 can be coupled to the first bubble tube 50, and pressure switch 72 can be coupled to the second bubble tube 58. Adjustable flow resistors 76 may be used to control the flow of fluid to the bubble tubes and/or one or more of the chambers. A valve 77 controls the flow of fluid to the level sensing station 18.

By connecting two pressure switches 70 to the first bubble tube 50, the detection of two toner levels (high and low) in the toner chamber 20 is possible; if three switches are connected, three levels can be detected. Likewise, by connecting two pressure switches 72 to the second bubble tube 58, the detection of two toner levels (high and low) in the developer roll chamber 26 is possible; if three switches are connected, three levels can be detected.

To sense the level of the toner in the toner chamber 20, the pressure switches 70 are responsive to pressure P of the fluid in the tube 50. Using Bernoulli's equation, known to those of ordinary skill in the art, the pressure P, together with the ambient atmospheric pressure above the toner in the toner chamber 20, may be used to obtain the height of the fluidized toner 22 in the toner chamber 20. Suppose, for example, that the pressure at the bottom of the bubble tube is P. Then the height of the fluidized toner, h, measured from the bottom of the bubble tube to the surface of the fluidized toner is given by $h=(P-P_a)/g\rho$, where $P_a$ is the ambient atmospheric pressure, g is the acceleration due to gravity, and $\rho$ is the density of the fluidized toner.

In one embodiment, three pressure switches 70 are coupled to the bubble tube 50. The three switches 70 permit the detection of three levels in the chamber 20, such as high, medium or low toner levels. If the switches 70 detect a high level, the system operator is instructed not to add any toner to the system since the refill chamber is full. If the switches 70 detect a medium level, the system operator is instructed to add only one cartridge full of toner. If the switches 70 detect a low toner level, the operator is instructed to add one or two cartridges of toner because the refill chamber is low. This three-level scheme gives the operator of the image forming system ample opportunity to replenish the image developer system 10 before it is fully depleted.

In one embodiment, two pressure switches 72 are coupled to the second bubble tube 58 that is immersed in the fluidized toner 22 in the developer roll chamber 26. Such an arrangement permits the detection of two levels, high and low toner levels, in a manner similar to the sensing of three levels, high, medium and low, described above. When the level in the developer roll chamber 26 is detected as low, the toner in the station 18 is fluidized as described above. When the level is detected as low, the fluidization of the toner in the station 18 is stopped with the valve 77, as described above.

To dry the toner effectively, and to feed the developer roll 28 with toner, the chambers 20 and 26 are fluidized continuously so long as the image developer system 10 is powered. The toner in the chamber of the level sensing station 18 is fluidized when the level of toner in the developer roll chamber 26 drops below a predetermined low level and the fluidization is maintained until the level returns to a predetermined high level. The two levels are detected by two pre-set pressure switches 72 hermetically attached to the bubble tube 58. The fluidization of the toner inside the chamber of the level sensing station 18 is interrupted by cutting off the supply of the fluidizing fluid to this chamber. The bubble tube 50 is used to detect three predetermined levels of the fluidized toner in the toner chamber 20 using three pre-set pressure switches 70 connected to the tube 50.

When the level is detected as low, the error messaging system instructs the operator to add tow cartridges of toner to the toner chamber 20. When the level is sensed as medium, the error message instructs the operator to add only one cartridge of toner. If the level is detected as high, no toner addition is allowed.

Figure 5B:
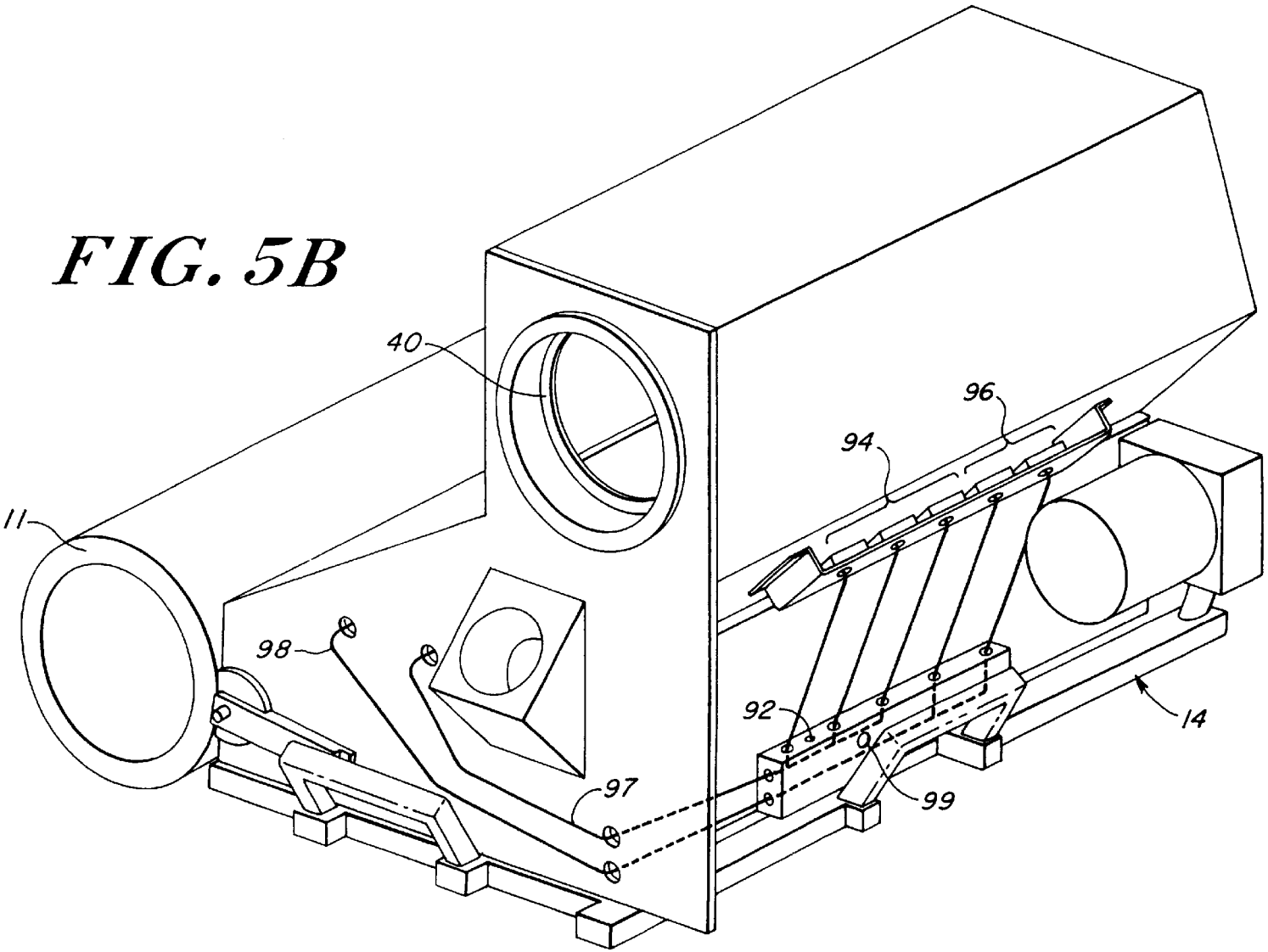
FIG. 5B shows a schematic of the pneumatic connections of the image developer according to the teachings of the present invention.

Referring to FIG. 5B, the pneumatic connections of the image developer system 10 are systematically illustrated. The image developer system 10 includes three toner chamber switches 94, and two developer roll chamber switches 96 coupled to a manifold 92. The manifold is coupled to the bubble tube 50 via a flexible rubber tubing 97, and to the bubble tube 58 via flexible rubber tubing 98. The manifold 92 also receives fluid from the fluid source 38 via the manifold bubble port 99.

The manifold 92 functions to receive fluid from the source 38, and redistribute the fluid to the bubble tubes 50 and 58 via the flexible tubings 97 and 98 respectively. The flexible tubing 97 carries fluid from the manifold 92 to the top end of the bubble tube 50, the tubing 97 entering the side of the image developer system 10 via the first bubble tube feed through 56. The flexible tubing 98 carries fluid from the fluid source 38 to the top end of the bubble tube 58, the tubing 98 entering the side of the image developer system 10 via the second bubble tube feed through 64. The three toner chamber switches 94 are utilized for toner level detection in the toner chamber 20, while the two developer roll chamber switches 96 are utilized for toner level detection in the developer roll chamber 26.

Referring back to FIG. 4, the developer roll station 24 included in the image developer system 10 is shown. The fluid from the source 38 is introduced into the developer roll station via the developer roll station fluid-intake port 36 (FIG. 3) and the pressure distributor 12. The distributor 12 functions to distribute the fluid substantially evenly throughout the bottom of the station 24 containing a bed of toner particles. The developer roll station 24 includes the chamber 26 used to house fluidized toner 22, which is transferred to the developer roll 28. The developer roll 28 is suitable for transferring the toner to the imaging member 11 to develop latent images thereon. The station 24 also includes a metering blade assembly 66 in contact with the developer roll 28, and the support 68 for a fluid filter or cover. The station 24 further includes an angled chamber wall 78.

The particles in the developer roll chamber 26 are fluidized continuously whenever the image forming system containing the image developer system 10 is activated. The angled chamber wall 78 promotes a circulation of the fluidized toner 22, as indicated by the arrow in FIG. 2. If the level of the fluidized toner 22 is kept below the developer roll 28, for example ⅛–⅜ inch below, the toner particles are attracted to the developer roll 28 by electromagnetic forces. Once on the developer roll 28, the toner can be transferred to the imaging member 11 to develop a latent image thereon. The blade assembly 66 may be used to scrape excess toner from the developer roll 28.

Figure 6:
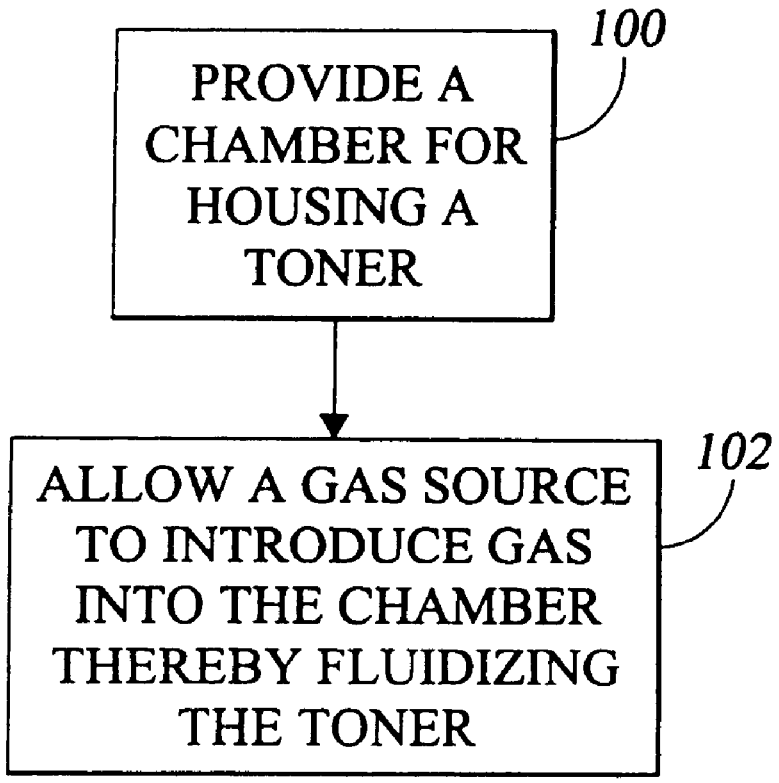
FIG. 6 shows a flow chart including steps for providing a fluidized toner in an image developer according to the teachings of the present invention.

Referring to FIG. 6, a flow chart including steps for providing a fluidized toner in an image developer system 10 is shown. In step 100, a chamber, such as a toner chamber 20, or a developer roll chamber 26, is provided for housing a toner. In step 102, a fluid source 38 is allowed to introduce fluid, such as atmospheric air, into the chamber thereby fluidizing toner to yield a generally fluidized toner 22 having substantially fluid characteristics.

The fluidization process, occurring when the fluid speed lies between about $V_{min}$ and $V_{max}$, suspends the toner particles in the fluidizing fluid without losing them to the atmosphere. In contrast, the conveying process, occurring when the fluid speed is greater than about $V_{max}$, results in the loss of toner particles as they are blown away by the fluid to the atmosphere. Even if a filter or cyclone or both are employed to collect the particles conveyed with the rapidly moving fluid, the toner loss is not eliminated because the collected particles cannot be reused. In the fluidization process of the present invention, the image developer system 10 may function without a top cover because toner is not conveyed into the atmosphere. In one embodiment, however, the image developer system 10 has a top filter, or a solid (non-permeable cover to prevent foreign particles or other objects from entering the chambers 20 and 26. The type of cover (solid/permeable) depends on the ability of the developer roll 28 to catch the toner particles that might be inadvertently carried by a stream of fluid through a vent opening located above the developer roll 28.

Additionally, the fluidization process provides agitation that prevents toner solidification or lumping in a gentle, non-destructive manner without a mechanical device in mechanical contact with the toner particles, and without an externally induced vibration. Especially in high humidity environments, toner particle drying described above, combined with agitation, makes the lump-prevention or lump-destruction more effective. Toner particles may also be charged by means of an ionized fluidizing fluid where non-conductive toners are used. Moreover, as described above, fluidized toner 22 lends itself to the use of bubble tubes 50, 58 to inexpensively and reliably measure the toner level.

An image developer system 10 utilizing a mono-component, conductive and magnetic toner is illustratively described above. It should be understood, however, that other configurations of the image developer system 10, other toners (such as dielectric toner), and toner treatments of the toner are possible. Toners may benefit from other treatments that may be conveniently applied via the fluidization process. For example, non-conductive toners may be electro-charged by exposing their particles to a gentle stream of an ionized gas. To improve the consistency of the charging process, the toner may be initially dried up to homogenize its dielectric properties prior to plasma-charging. The drying and plasma-charging treatments may have to be applied independently.

In one embodiment, a configuration of three independently fluidized beds may provide the means to apply both treatments. A supply of toner contained in a toner chamber 20 (drying toner chamber) may be fluidized with dry air. A second supply of toner, contained in a second chamber, such as a developer roll chamber 26 (charging second chamber), may be fluidized with an ionizing gas for charging. The two beds may be connected by an intermediate chamber, such as one contained within the level sensing station 18. The three chambers may share two common walls with small openings located at the bottom of the beds. The opening is "open" when the toner in the intermediate chamber is in the state of fluidization allowing the passage of dried toner from the toner chamber 20 to the second chamber 26 where the toner is ionized. Otherwise, the drying toner chamber 20 and the charging second chamber 26 are separated. This gating action of the intermediate chamber does not employ any mechanical moving parts that may contribute to toner lumping, or otherwise negatively affect the toner, or the drying and charging of the toner.

It should be noted, however, that for other toners, additional and different treatments may be required. The treatments may involve the use of a plurality of fluidizing fluids, either mixed or applied separately in one or many distinct fluidizing chambers. Therefore, the image developer system capable of executing an appropriate toner treatment may be structured to comprise any number of fluidizing chambers, separated or not separated by intermediate gating chambers and equipped with level sensing devices accordingly.

Those skilled in the art will recognize, or be able to ascertain using no more than routine experimentation, many equivalents to the specific embodiments and methods described herein. Such equivalents are intended to be encompassed by the scope of the following claims.

What is claimed:

1. An image developer system that provides a generally fluidized toner suitable for use in an image forming system, the image developer system comprising:

a chamber that houses toner particles;

a level sensing subsystem that measures a level of the toner particles in the chamber;

a fluid source that introduces fluid into the chamber at a velocity to fluidize the toner particles to yield a generally fluidized toner having substantially fluid characteristics; and a conditioning element that conditions the fluid prior to introducing the fluid into the chamber.

2. The system of claim 1, wherein the fluidized toner particles are subjected to a drag force that approximately cancels a gravitational force on the fluidized toner particles.

3. The system of claim 1, further comprising a pressure distributor for distributing the fluid substantially evenly throughout a bottom of the chamber.

4. The system of claim 1, wherein the conditioning element dries the fluid prior to introducing the fluid into the chamber.

5. The system of claim 1, wherein the fluid source cools the fluid prior to the introduction to the chamber.

6. The system of claim 1, wherein the fluid source brings a dew point of the fluid to below about −40° F. before introducing the fluid into the chamber.

7. The system of claim 1, wherein the chamber has an angled wall for promoting circulation of the generally fluidized toner therein.

8. The system of claim 1, further comprising a developer roll for attracting the fluidized toner onto a surface thereof.

9. The system of claim 1, wherein the fluid source includes the conditioning element.

10. An image developer system that provides a generally fluidized toner suitable for use in an image forming system, the image developer system comprising:

a chamber that houses toner particles; and a fluid source that introduces fluid into the chamber at a velocity to fluidize the toner particles to yield a generally fluidized toner having substantially fluid characteristics, wherein the velocity of the fluid introduced into the chamber is between about 0.003 and about 8.4 centimeters per second.

11. A method for providing a generally fluidized toner suitable for use in an image forming system, the method comprising:

housing toner particles in a chamber;

sensing a level of the toner particles within the chamber; and fluidizing the toner particles with a fluid introduced into the chamber at a velocity, to fluidize the toner particles to yield a generally fluidized toner having substantially fluid characteristics, wherein fluidizing the toner particles includes conditioning the fluid prior to introducing the fluid into the chamber.

12. The method of claim 11, wherein, in the step of fluidizing the fluidized toner particles are subjected to a drag force that approximately cancels a gravitational force on the fluidized toner particles.

13. The method of claim 11, wherein, in the step of fluidizing, the velocity is between about 0.003 and about 8.4 centimeters per second.

14. The method of claim 11, further comprising the step of substantially evenly distributing the fluid throughout a bottom portion of the chamber.

15. The method of claim 11, further comprising:

immersing a bottom end of a bubble tube in the fluidized toner; and measuring a level of the fluidize toner using the bubble tube having the bottom end immersed in the fluidize toner.

16. The method of claim 11, further comprising the step of conditioning the fluid prior to introduction to the chamber.

17. The method of claim 11, further comprising the step of cooling the fluid prior to introduction to the chamber.

18. The method of claim 11, further comprising the step of promoting circulation of the generally fluidized toner within the chamber.

19. The method of claim 11, further comprising the step of attracting the fluidized toner onto a surface of a developer roll.

* * * * *